United States Patent [19]

Benedict

[11] Patent Number: 4,646,599

[45] Date of Patent: Mar. 3, 1987

[54] HYDRAULIC PUNCH PRESS WITH WORKPIECE STRIPPER

[75] Inventor: Roger J. Benedict, Rockford, Ill.

[73] Assignee: Roper Whitney Co., Rockford, Ill.

[21] Appl. No.: 831,478

[22] Filed: Feb. 20, 1986

[51] Int. Cl.[4] ..... B26F 1/02

[52] U.S. Cl. ..... 83/131; 83/137; 83/140

[58] Field of Search ..... 83/131, 137, 140, 125

[56] References Cited

U.S. PATENT DOCUMENTS

| | | | |
|---|---|---|---|
| 3,033,065 | 5/1962 | Fuller | 83/131 |
| 3,119,293 | 1/1964 | Allen et al. | 83/131 |
| 3,664,692 | 5/1972 | Spieth . | |
| 3,722,337 | 3/1973 | Brolund et al. | 83/137 |

*Primary Examiner*—James M. Meister
*Attorney, Agent, or Firm*—Vernon J. Pillote

[57] ABSTRACT

A punch press having a hydraulic actuator for extending and retracting the ram, a stripper sleeve coaxial with and guidably engaging the ram, and a hydraulically operated clamp encircling the stripper sleeve and normally in a release condition guidably engaging the stripper sleeve. Hydraulic fluid pressure supply apparatus is operable to a first condition supplying fluid pressure to the hydraulic ram actuator to move the ram forwardly, and a stripper clamp spring yieldably urges the stripper sleeve forwardly into clamping engagement with the workpiece as the ram is moved forwardly. The hydraulic fluid pressure supply apparatus is operable to a second condition supplying fluid pressure to the hydraulically operated clamp to clamp the stripper sleeve against movement and to also supply fluid pressure to the hydraulic ram actuator to move the ram to a return position while the clamp holds the sleeve against return movement. A stripper return spring yieldably urges the stripper sleeve to a return position when the ram is in its return position and the hydraulically operated clamp is released.

15 Claims, 7 Drawing Figures

HYDRAULIC PUNCH PRESS WITH WORKPIECE STRIPPER

BACKGROUND OF THE INVENTION

Punch presses commonly utilize a stripper to clamp the workpiece in position during the punching operation and to strip the workpiece off the punch during retraction of the ram. The present invention relates to a punch press of the type having a hydraulic actuator for extending and retracting the press ram alternately into and out of engagement with the workpiece and having a stripper mechanism operated in timed relation with the ram.

SUMMARY OF THE INVENTION

It is the general object of the present invention to provide a hydraulically operated punch press having a stripper operated in timed relation with the ram and which can accommodate workpieces of different thickness without adjustment of the stripper.

A more particular object of this invention is to provide a hydraulically operated punch press having an improved arrangement for guiding and operating the stripper in which the stripper is spring actuated into engagement with the workpiece during extension of the ram to clamp the workpiece to the stationary tool; the stripper is hydraulically clamped against axial movement during retraction of the ram with a force sufficient to strip the workpiece off the movable tool, and the stripper thereafter released and spring actuated to its return position when the ram reaches a retracted position.

Another object of this invention is to provide a hydraulically operated punch press and stripper in accordance with the foregoing object and having an improved arrangement for automatically operating the hydraulically actuated stripper clamp in timed relation with the operation of a hydraulic actuator for the ram, to effect clamping of the stripper against movement before the ram is moved in its return stroke.

Accordingly, the present invention provides a punch press having a hydraulic actuator for extending and retracting the ram, a stripper sleeve coaxial with and guidably engaging the ram, and a hydraulically operated clamp encircling the stripper sleeve and normally in a release condition guidably engaging the stripper sleeve. Hydraulic fluid pressure supply means is operable to a first condition supplying fluid pressure to the hydraulic ram actuator to move the ram forwardly, and stripper operating spring means are provided to yieldably bias the stripper sleeve forwardly into clamping engagement with the workpiece as the ram is moved forwardly. The hydraulic fluid pressure supply means is operable to a second condition supplying fluid pressure to the hydraulically operated clamp to clamp the stripper sleeve against movement and to also supply fluid pressure to the hydraulic actuator to move the ram to a return position while the clamp holds the sleeve against return movement. The stripper operating spring means includes means for yieldably urging the stripper sleeve to a return position when the ram is in its return position and the hydraulically operated clamp is released.

BRIEF DESCRIPTION OF THE DRAWINGS

The punch press includes a C-shaped press frame conveniently formed by two laterally spaced plates 21 of generally C-shaped configuration to provide a forwardly opening throat or work opening. As best shown in FIG. 1, the C-shaped plates 21 are secured at their lower ends to a support plate 22 that is mounted on a support stand 23. A generally horizontal work table 24 is mounted on the press frame and support plate as by members 20*a* 20*b* to extend across the throat in the C-shaped press frame. A die block 25 is attached to and extends between the lower legs of the C-shaped plates 21 and is arranged to removably support a die adapter 26 that receives a stationary tool or die 27. As shown, the die adapter and die extend through an opening 24*a* in the work support platform 24 and are arranged to engage the underside of a workpiece W. A movable tool or punch 32 is mounted on a ram 33 and a hydraulic ram actuator 34 is connected to the ram for reciprocating the movable tool toward and away from the stationary tool. The hydraulic ram actuator includes a cylinder 35 and a piston 36 movable in the cylinder and having a piston rod 37 extending out of the cylinder. The cylinder 35 is fixedly mounted on a plate 38 that is secured to and extends between the upper legs of the C-shaped plates 21, and the piston rod 37 is connected through a coupling 39 to the ram 33 to axially reciprocate the ram vertically toward and away from the stationary die 27. As shown in FIG. 2, the piston 36 separates the cylinder into upper and lower chambers 35*a* and 35*b* at relatively opposite sides of the piston and the hydraulic actuator is operative when fluid pressure is supplied to chamber 35*a* to move the ram downwardly in a punch stroke and operative when fluid pressure is supplied to the chamber 35*b* to move the ram upwardly in a return stroke.

A stripper sleeve 41 is disposed coaxial with the ram and guidably engages the ram for relative axial movement therebetween. The stripper sleeve has a work engaging head 42 at its lower end that encircles the punch 32 and which has a downwardly facing work engaging face 42*a* arranged to engage the workpiece W at a location outwardly of the path of movement of the punch.

Figure 2:
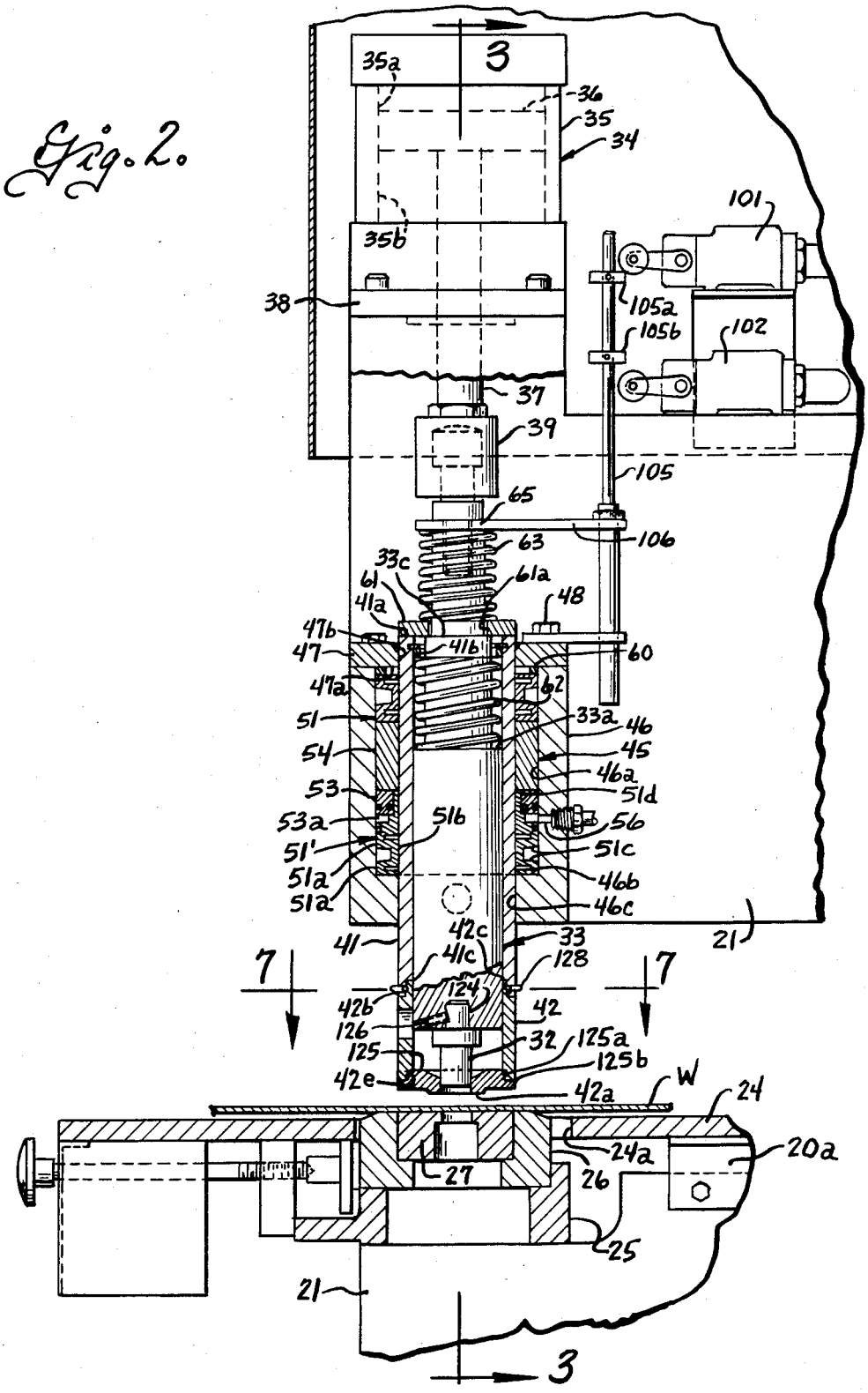
FIG. 2 is a fragmentary vertical sectional view taken on the plane 2—2 of FIG. 1 illustrating parts in section and on a larger scale than FIG. 1.

A hydraulically operated stripper sleeve clamp 45 is mounted on the press frame and encircles the stripper sleeve. The sleeve clamp is mounted in a clamp housing 46 that is disposed between and rigidly secured to the upper legs of the C-shaped plates 21. The clamp housing has a generally cylindrical inner wall 46*a* that is spaced radially outwardly from the shaft, an end wall defining a shoulder 46*b* at one end of the cylindrical wall and an annular wall 46*c* that loosely surrounds the stripper sleeve. The housing also includes a cover plate 47 removably secured to the upper end of the housing as by fasteners 48 and which cover plate defines a shoulder 47*a* at the upper end of the cylindrical wall 46*a*, and an annular wall 47*b* that loosely surrounds the stripper sleeve. An annular hydraulically operated clamp means is disposed inside the cylindrical wall 46*a* of the clamp housing and is operative between a release condition guidably engaging the stripper sleeve and a clamp condition in which it is radially expanded into clamping engagement with the stripper sleeve to clamp the same against axial movement. The annular hydraulically operated clamp is preferably of the type disclosed in U.S. Pat. No. 3,664,692 and, in general includes one or more annular clamp rings, herein shown two in number and designated 51 and 51' which are adapted to radially expand when axially compressed, and an annular hydraulic actuator 53 operable to axially compress the clamp rings. In the embodiment shown, the locking rings each include axially spaced annular outer portions 51*a*that engage the wall 46*a* of the clamp housing and an annular inner portion 51*b* arranged to engage the stripper sleeve, and integral ring portions 51*c* that extend from the ends of the annular inner portion 51*b* outwardly to adjacent ends of the annular outer portions 51*a* at an included angle of slightly greater than 90° and such that, when the annular outer portions are axially compressed toward each other, the ring portions distend the annular inner portion 51*b* into clamping engagement with the stripper sleeve. The hydraulic actuator 53 is arranged to axially compress the locking rings and, in the embodiment shown, is in the form of an annular piston that is slidably sealed by O-rings to the housing wall 46*a* and to an axial extension 51*d* on the clamp ring 51', to form an actuator chamber 53*a* between the piston and the clamp ring 51'. The annular piston engages one end of a movable annular spacer ring 54, and the other end of the annular spacer ring engages the other clamp ring 51. Thus, when fluid pressure is supplied to the chamber 53*a*, the fluid pressure axially compresses the lower clamp ring 51' and the fluid pressure on the piston is transmitted through the spacer ring 54 to the other clamp ring 51 to axially compress the same. A shim or shims 60 can be interposed between the cover plate 47 and the upper clamp sleeve, to control the initial axial preload on the clamp ring, that is the preload when fluid pressure is exhausted from the actuator chamber 53*a*. The initial axial preload can be adjusted to control the normal sliding clearance between the clamp rings and the stripper sleeve and also control the amount of fluid pressure that must be supplied to the clamp chamber 53*a* in order to achieve a clamping force of a desired magnitude. As disclosed in the aforementioned patent, the clamping rings can be partially slotted in a longitudinal direction at circumferentially spaced locations to enhance radial expansion of the clamping rings in response to axial compression. As shown in FIG. 2, fluid is supplied to and exhausted from the pressure chamber 53*a* through a passage 56 in the housing 46. Thus, the annular hydraulically operated clamp guides the stripper sleeve when the clamp is in its release condition and clamps the stripper sleeve against axial movement when in its clamp condition.

Stripper operating spring means are provided for yieldably biasing the stripper sleeve downwardly into clamping engagement with the workpiece when the ram is moved downwardly, and for yieldably biasing the stripper sleeve upwardly to a retracted position when the ram is moved upwardly and the hydraulically operated sleeve clamp is released. The stripper operating spring means includes an annular abutment member 61 conveniently in the form of a flat plate having an inner opening 61*a* and an outer diameter sufficiently large to overlie the upper end 41*a* of the stripper sleeve. The ram 33 has a main body portion that is slidably disposed in the stripper sleeve, an upwardly facing shoulder 33*a* disposed below the upper end of the stripper sleeve, a reduced diameter portion 33*b* extending upwardly from the shoulder 33*a*, a second upwardly facing shoulder 33*c* at the upper end of the portion 33*b* and a second reduced diameter portion 33*d* extending upwardly from the shoulder 33*c*. A coil type return spring 62 is disposed around the portion 33*b* of the ram with its lower end engaging the shoulder 33*a* and its upper end engaging a downwardly facing shoulder or abutment formed by a ring 41*b* provided in the stripper sleeve below its upper end and retained in position by a lock ring. A coil type clamp spring 63 encircles the reduced diameter portion 33*d* of the ram and has its lower end arranged to engage the abutment plate 61 and its upper end arranged to engage an abutment 65 that is fixed to and movable with the ram. When the hydraulic sleeve clamp is released and the ram is in its raised condition as shown in FIG. 2, the return spring 62 will yieldably bias the stripper sleeve upwardly. The clamp spring 63 is selected so as to be somewhat stronger than the return spring and yieldably presses the abutment 61 downwardly against the upper end of the stripper sleeve and presses the stripper sleeve downwardly relative to the ram until the abutment member 61 engages the shoulder 33*c* on the ram. In the raised or return position of the ram and stripper as shown in FIG. 2, the stripper sleeve is constructed and arranged so that the lower work engaging face 42*a* is spaced slightly below the lower end of the punch 32 so that, when the ram is thereafter moved downwardly, the stripper sleeve engages the workpiece slightly before the punch to clamp the workpiece to the stationary die. Thus, the stripper is yieldably biased into a workpiece clamp position in engagement with the workpiece during extension of the ram and the hydraulically operated stripper clamp is operated to clamp the stripper sleeve in its workpiece clamp position during retraction of the ram. The stripper will accordingly automatically accomodate workpieces of different thickness without adjustment.

A control apparatus is provided for operating the ram actuator under the control of a cycle switch CS to move the ram through punch and return strokes and for automatically operating the hydraulically operated stripper sleeve clamp to clamp the stripper sleeve against upward movement during retraction of the ram, to thereby strip the workpiece off the punch. As diagrammatically shown in FIG. 5, the fluid pressure supply means includes a pump P driven by a motor MR and operative to supply hydraulic fluid from a reservoir R to a pressure supply line 75. A four-way, three position control valve 76 has an inlet port 76*a* connected to the fluid supply line 75 and a return port 76*b* connected to a fluid return line 77, and a first and second controlled outlet ports 76*c* and 76*d*. The controlled outlet port 76*c* is connected through a line 78 to the cylinder 35 to communicate with the chamber 35*a*. The other controlled outlet port 76*c* is connected through a line 79, sequence valve 80 and pilot operated check valve 81 and line 82 to the cylinder 35 to communicate with the other pressure chamber 35*b*. The line 79 from controlled outlet port 76*c* is also connected through a line 84 to an inlet port 85*a* on a bypass valve 85, the outlet port 85*c* of which is connected through a line 86 to the hydraulically operated clamp 45. Bypass valve 85 also has a port 85*b* that is connected through line 88 and return line 77 back to the reservoir R. Bypass valve 85 is normally spring biased to the position shown in FIG. 5 communicating port 85*a* with port 85*c* and has an electroresponsive actuator 91 operable to move it to a second position communicating port 85*c* with port 85*b*. A pressure relief valve 93 is connected between the pressure supply line 75 and return line 77 to limit the maximum pressure supply to the system. A manually operable two-position valve 94 has its ports 94*a* and 94*b* respectively connected to the return line 77 and pressure supply line 75 and a port 94*c* connected to a pressure gauge 95. Valve 94 is normally positioned to communicate the port 94*c* with port 94*a* and is manually operable to second position communicating port 94*b* with the port 94*c* to supply pressure from the supply line to the gauge 95, when it is desired to check the system pressure. The four-position three-way control valve 76 has an open center position and is normally spring biased to its open center position and is selectively operable to an "up" or "down" position by electroresponsive actuators 96*a* and 96*b*.

The upper return and the lower punch positions of the ram are controlled by an upper ram position limit switch 101 and a lower ram position limit switch 102. The ram position limit switches can conveniently be mounted by brackets on the C-frame as shown in FIG. 2 and operated by switch actuators 105*a* and 105*b* adjustably mounted on an actuator rod 105 connected as by a bracket 106 to the ram for movement therewith.

Figure 6:
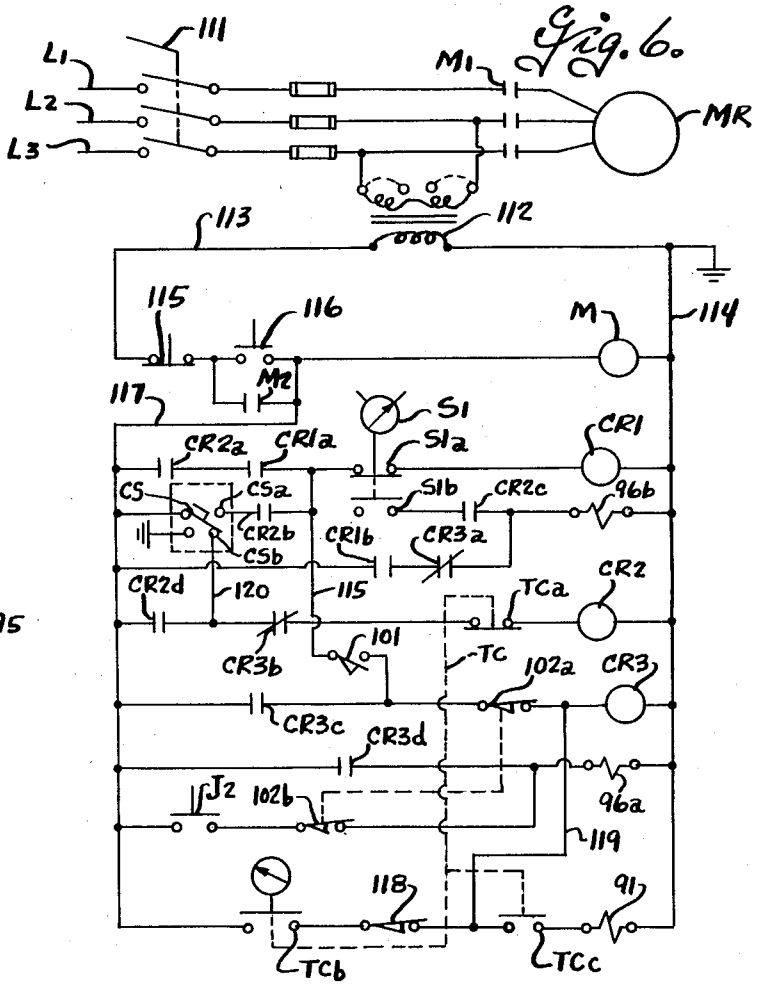
FIG. 6 is a schematic electrical diagram illustrating the electrical controls for the punch press.

As schematically shown in FIG. 6, power is supplied from line conductors L1, L2 and L3 through a manually operable switch 111 and normally open relay contacts M1 to the pump drive motor MR. Power is also supplied under the control of switch 111 through transformer 112 to a low voltage control circuit including control conductor 113 and ground conductor 114. Control conductor 113 is connected through a normally closed, manually operable stop switch 115 and a normally open manually operable start switch 116 to a motor control relay M that is operative, when the start switch is closed, to close relay contacts M1 to start the pump motor and also close relay contacts M2 to establish a holding circuit to the relay M and to a control conductor 117. Control conductor 117 is connected through normally open relay contacts CR2*a* and normally open relay contacts CR1*a* and through contacts S1*a* of a two-position "jog-cycle" switch S1 to control relay CR1. As illustrated in FIG. 6, switch S1 is positioned to close contacts S1*a* for single cycle operation. Conductor 117 is also connected to a two-position cycle control switch CS and one contact CS*a* of switch CS is contacted through normally open relay contacts CR2*b* to the jog-cycle switch S1. The other contact CSb of control switch CS is connected through a conductor 120, normally closed relay contacts CR3*b* and through normally closed contacts TCa of a tool change switch TC to control relay CR2. Tool change switch TC is positioned as shown to close contacts TCa when the switch is in its "run" position and cycle control switch CS is normally biased into engagement with contact CSb to energize relay CR2. Control conductor 117 is connected through normally open relay contacts CR2*d* to conductor 118 and energization of relay CR2 closes contact CR2*d* to establish a holding circuit to relay CR2. Energization of relay CR2 also closes normally relay contacts CR2*a*, CR2*b* and CR2*c* and, when the cycle control switch CS is thereafter moved into engagement with contacts CSa, it establishes a circuit to control relay CR1 to energize the same and also establishes a circuit to the down valve actuator 96*b* to move the control valve 76 to its down position. When relay CR1 is energized, it closes normally open relay contacts CR1*a* to establish a holding circuit to relay CR1 until relay CR2 is thereafter de-energized. Relay contacts CR2*a* and CR1*a* are also connected through line 115 and a normally open "down" limit switch 101 and through normally closed contacts 102*a* of "up" limit switch 102 to control relay CR3. The up limit switch 102 is held open when the ram is in its raised position and, when the ram moves downwardly, switch 102 closes contacts 102*a* and 102*b*. When the ram reaches its lower or punch position, normally open down limit switch 101 is closed and this energizes relay CR3. Energization of relay CR3 closes normally open contact CR3*c* to establish a holding circuit to relay CR3 and energization of relay CR3 also opens normally closed contacts CR3*a* and CR3*b* to de-energize the down valve actuator 96*b* and control relay CR2. Energization of control relay CR3 also closes normally open relay contacts CR3*d* connected in series with the up valve actuator 96*a* to energize the same and move the valve to a second control position supplying fluid pressure to control outlet port 76*c* while exhausting fluid pressure from control outlet port 76*d*. When the ram thereafter reaches its raised position, it opens a normally closed limit switch contacts 102*a* and de-energizes relay CR3. When relay CR3 is de-energized, relay contacts CR3*d* open and de-energize the up valve actuator 96*a* so that the valve 76 returns to its open center position shown in FIG. 5.

The ram has a relatively short operating stroke and provision is made for raising the ram above its normal return position, to facilitate tool changing. Manually operable tool change switch TC also has contacts TCb and TCc that are open in its "run" position and, when the switch TC is moved to its tool change position, contacts TCb and TCc are closed and contacts TCa are opened. Contact TCb is connected in series with a normally closed tool change limit switch 118 and line 119 to control relay CR3 and is also connected through contacts TCc to the valve actuator solenoid 91 for bypass valve 85. Thus, operation of the tool change switch TC to its tool change position, energizes actuator 91 for the bypass valve to move the bypass valve to a bypass condition exhausting fluid pressure from the clamp actuator 45. Energization of relay CR3 closes normally open contacts CR3*d* and energizes valve actuator 96*a* to its raise position and relay CR3 remains energized until the tool change limit switch 118 is opened at a preselected upper tool change position above the normal return position.

The switch S1 can also be moved to a "down jog" position opening contacts S1*a* and closing contacts S1*b* to jog the ram downwardly. A normally open manually operable jog switch J2 is connected in series with normally closed contacts 102*b* of up limit switch 102 so that the ram can be jogged to a raised position until the ram opens switch contacts 102*a* and 102*b*.

The punch 32 is removably mounted on the lower end of the ram to enable installation of punches of different size. As shown in FIG. 2, the punch 32 is removably retained in a recess 124 in the lower end of the ram 33 by a set screw 126. The stripper head 42 is detachably mounted on the lower end of the stripper sleeve 41 to facilitate access to the punch 32 and to also enable the changing of stripper heads. As shown in FIGS. 2–4 and 7 the stripper head 42 has an outwardly facing shoulder 42*b* arranged to engage the lower end of the stripper sleeve, and a reduced diameter extension 42*c* that extends into a counterbore 41*c* in the lower end of-the stripper sleeve. The reduced diameter extension 42*c* of the stripper head is also provided with annular recess 42*d* in its outer periphery, and the lower end of the stripper sleeve is formed with a plurality of angularly spaced secantially extending slots 41*d* at a location to register the groove 42*d* when the stripper head is assembled on the stripper sleeve (See FIG. 7). An undulated clamp ring 128 is formed with circumferentially spaced portions 128*a* arranged to extend around the outer periphery of the stripper sleeve and intermediate portions 128*b* that are offset inwardly and arranged to extend through the slots 41*d* and into the recess 42*d* in the head 42, to releasably retain the head on the stripper sleeve. The ends of the ring 128 overlap and are formed with outwardly extending finger engaging portions 128*c* which can be manually pressed toward each other to expand the clamp ring to a release condition.

Figure 4:
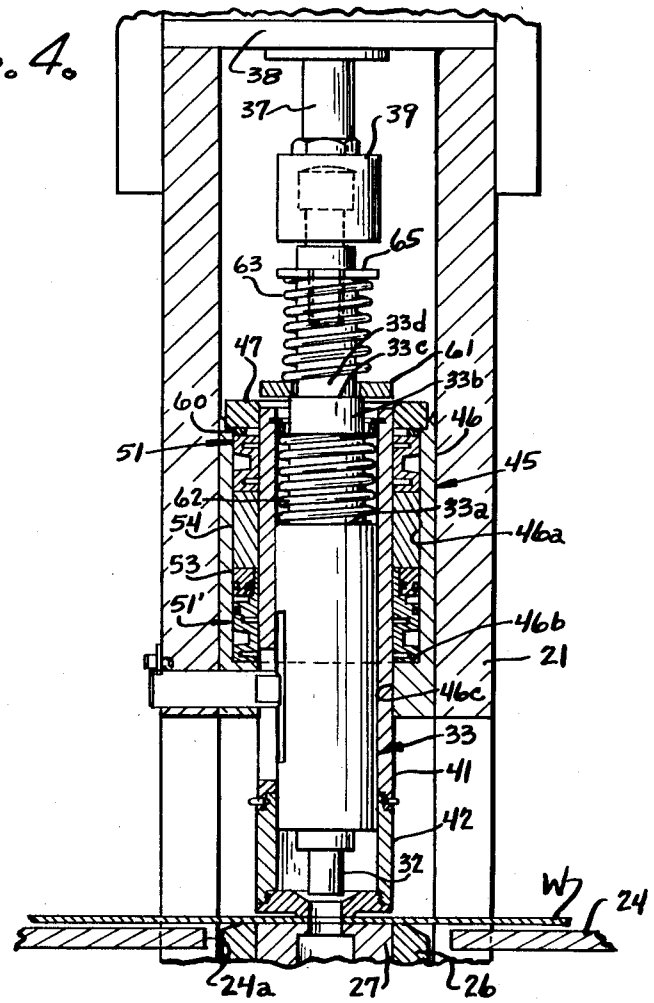
FIGS. 3 and 4 are fragmentary transverse sectional views taken on the plane 3—3 of FIG. 2 and illustrating the parts in different moved positions.
Figure 3:
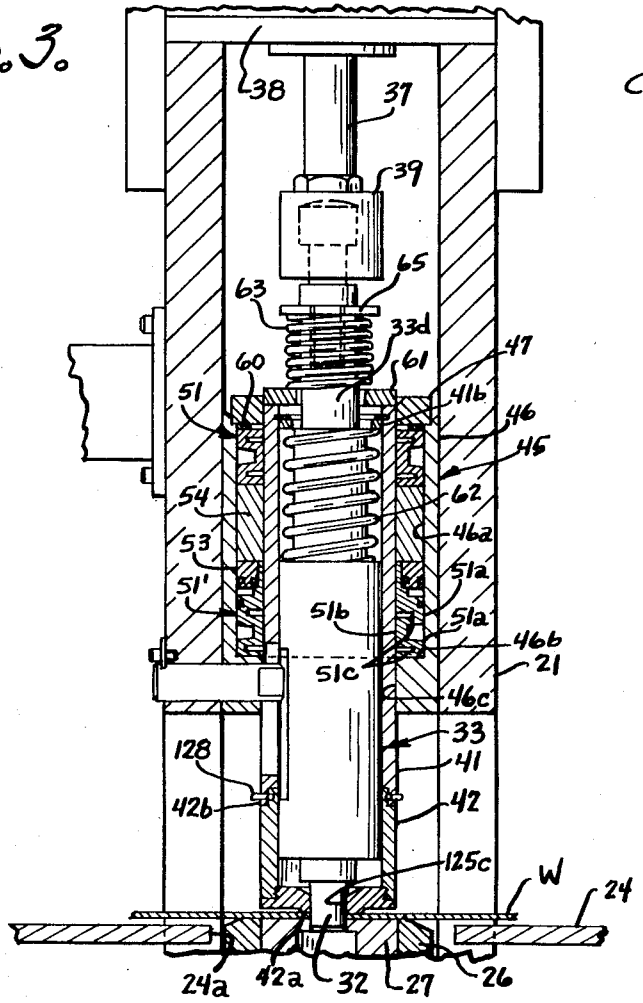

It is contemplated that stripper heads 42 having different size punch receiving openings can be provided for different size punches. However, provision is also made for adapting the stripper head for use with a range of punch sizes. As shown in FIGS. 2–4, the stripper head 42 is formed with a generally cylindrical internal configuration and has an internally threaded lower portion 42*e*. Stripper head adapters 125 are provided with an externally threaded portion 125*a* that is adapted to be threadedly received in the threaded portion 42*e* and an outwardly extending shoulder 125*b* that engages the lower end of the stripper head. The adapters 125 are formed with an opening 125*c* dimensioned to receive the punch 32 and adapters with different size openings 125*c* can be used for different size punches. The stripper engaging face 42*a* is formed on the lower end of the adapters 125.

Figure 1:
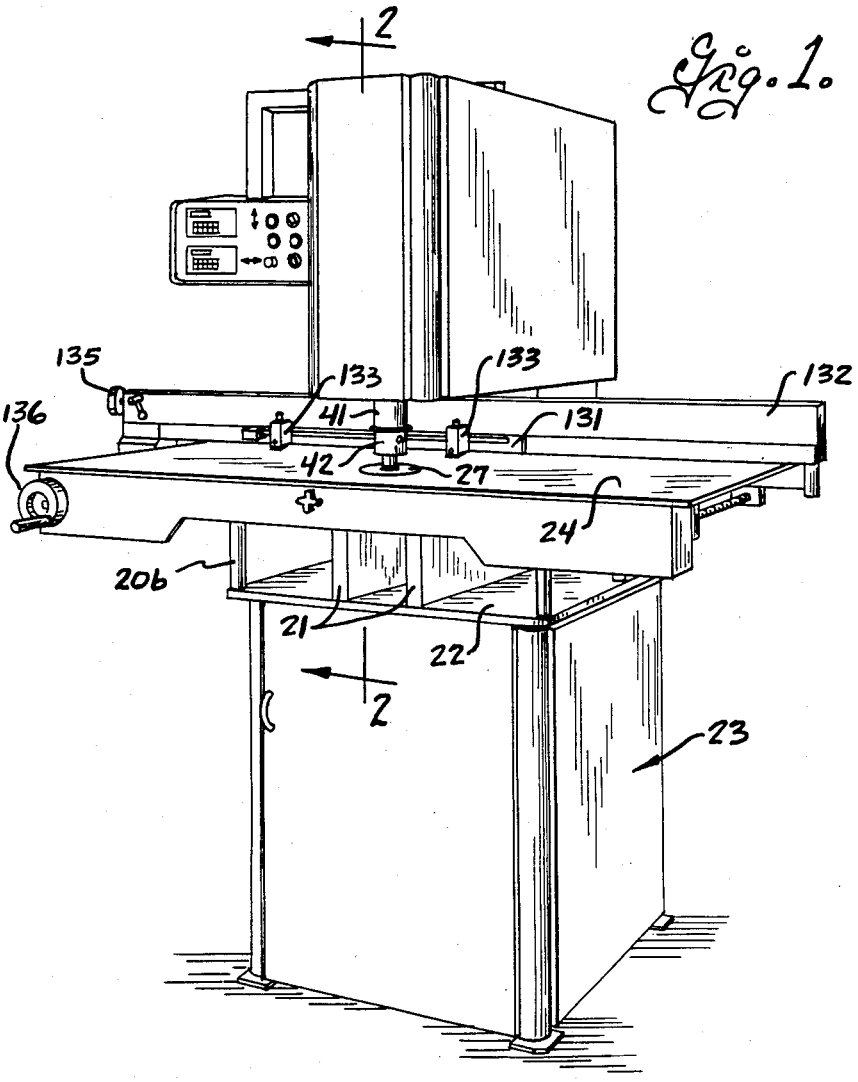
FIG. 1 is a perspective view of a punch press embodying the novel features of the present invention.
Figure 7:
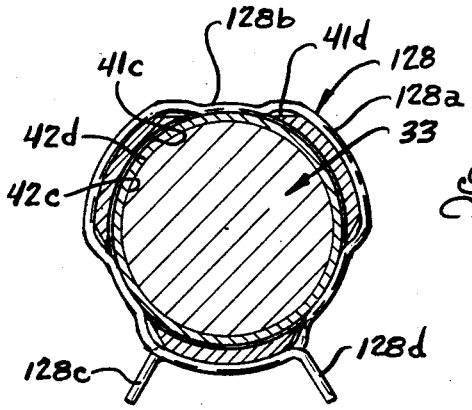
FIG. 7 is a fragmentary transverse sectional view taken on the plane 7—7 of FIG. 2.

The punch press can be of the type in which the workpiece is manually positioned on the work table 24 at the location desired for a punching operation. Preferably punch press is of the type having carriage means 131, 132 and clamp means 133 for clamping a workpiece to the carriage means for movement by the carriage means along X and Y axes. As shown in FIG. 1, the carriage 131 is mounted on carriage 132 for movement lengthwise thereof along an X axis and carriage 132 is in turn supported for movement relative to the work table in a transverse direction along a Y axis. The clamp means 133 is selectively operable to clamp the workpiece to the carriage 131. Carriage 131 can be manually positioned relative to carriage 132 as by a crank 135 that operates a first carriage positioning means (not shown) and carriage 132 can be manually positioned relative to the work table as by a crank 136 that operates a second carriage positioning means (not shown) and the press then manually actuated as by foot or hand switches. Alternatively, it is also contemplated that the carriage positioning means can be be provided with power drives and numerical control apparatus provided to effect automatic positioning of the workpiece in successive locations relative to the stationary die of the press and operation of the punch press in timed relation with the carriage positioning means.

From the foregoing it is thought that the construction and operation of the punch press will be readily understood. At the end of a punch cycle, the ram is raised to a position opening limit switches 102*a* and 102*b* and the control valve 76 is in its center position shown in FIG. 5. Check valve 81 closes to block flow from the chamber 35*b* of the ram actuator to hold the ram in its raised position. When the cycle control switch CS is operated, either manually as by a foot or hand operated switch, or automatically under a computer numerical control apparatus, valve actuator 96*b* is energized and moves the valve to a first condition supplying fluid pressure to controlled outlet port 76*d* and exhausting fluid pressure from controlled outlet port 76*c*. Pressure from port 76*d* is supplied through conduit 78 to chamber 35*a* in the ram actuator and pressure is also supplied through pilot line 81*a* to the pilot operated check valve 81 to open the same and allow fluid to flow from chamber 35*b* through line 82, check valve 81, bypass check valve 80*a* back to control outlet port 76*c*. Control outlet port 76*c* also communicates through bypass valve 85 with the hydraulically operated stripper clamp 45 so that the clamp is in a release condition when the ram moves downwardly. As the ram moves downwardly, clamp spring 63 yieldably urges the stripper sleeve downwardly. The work engaging end 42*a* of the stripper is normally positioned slightly below the lower end of the punch as shown in FIG. 2 and engages the workpiece to clamp it against the stationary die slightly before the punch engages the workpiece. The clamp spring 63 is arranged to apply a preselected clamping force, for example 150 pounds, to the workpiece sufficient to hold the workpiece against the die during punching.

When the ram moves away from its raised or return position, it allows the normally closed upper limit switches 102*a* and 102*b* to close and, when the ram reaches a preselected lower punch position as shown in FIG. 3, it operates the down limit switch 101 and energizes valve actuator 96*a* to move the valve 76 to a second condition in which fluid pressure is supplied to controlled outlet port 76*c* and exhausted from controlled outlet port 76*d*. Fluid pressure from controlled outlet port 76*c* is supplied through valve 85 and line 86 to the hydraulically operated clamp 45 to clamp the stripper sleeve in its lower work engaging position. The stripping force required to withdraw the punch from the hole in the workpiece is substantially less than the force required during punching, but is still relatively high. The hydraulic pressure operated clamp 45 is selected to provide a static holding force sufficiently high to hold the stripper sleeve against axial movement when moderate fluid pressures of the order of 1000 psi is supplied thereto. For example, an annular hydraulically operated clamp of the type disclosed can provide a static holding force of the order of 4000 to 6000 pounds on a 3.75″ diameter sleeve, when the fluid pressure supplied thereto is of the order of 1000 psi. Pressure from controlled outlet port 76*c* is also supplied to adjustable sequence valve 80 which delays application of fluid pressure to line 82 and to the lower chamber 35*b* of the ram actuator until the pressure reaches a preselected value sufficient to assure that the hydraulically operated clamp 45 will be actuated and hold the stripper against upward movement during retraction of the punch from the workpiece. As the ram moves upwardly, the stripper sleeve is held in its work engaging position as shown in FIG. 4 and the return spring 62 is compressed. The shoulder 33*c* on the ram engages the abutment member 61 and lifts the abutment member off the end of the stripper to allow some upward over-travel of the ram relative to the stripper.

Figure 5:
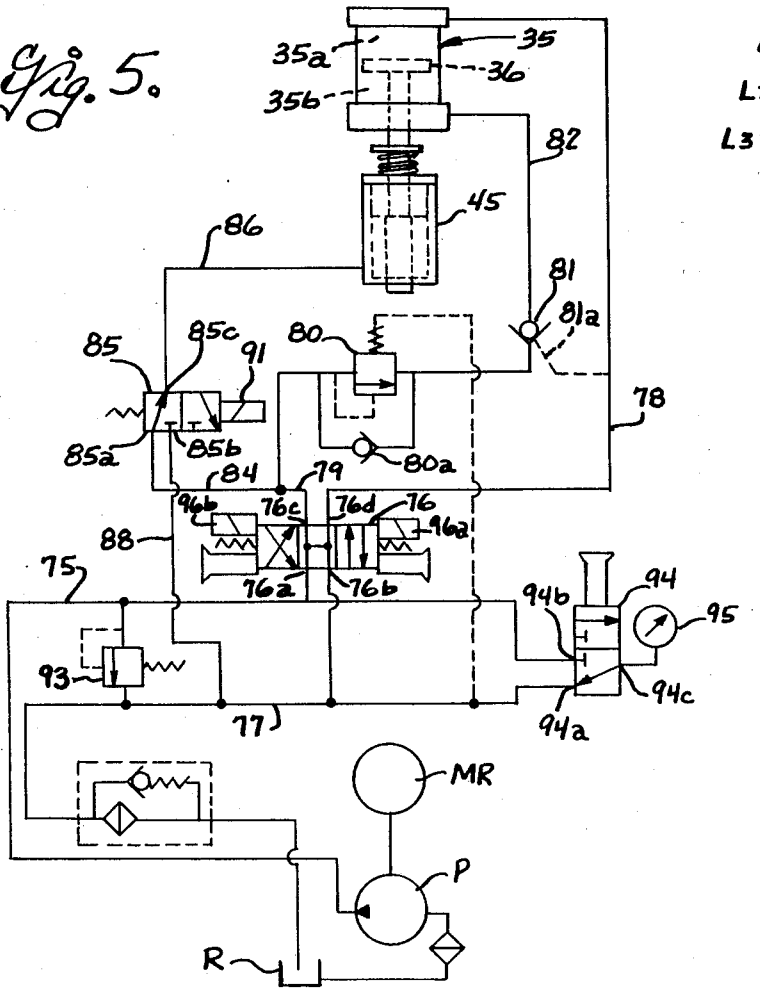
FIG. 5 is a diagrammatic view illustrating the hydraulic controls for the punch press.

When the ram reaches its raised or return position, it opens the normally closed upper limit switches 102*a* and 102*b* and de-energizes valve actuator 96*a* so that the control valve 96 returns to its center position shown in FIG. 5. Control valve 76 has an open center position and in this position exhausts fluid pressure from the stripper sleeve clamp so that the clamp returns to its release condition and allows the stripper sleeve to move upwardly to the position shown in FIG. 2 under the bias of return spring 62. When the control valve 76 is in its center position, the supply of fluid pressure to the chamber 35*b* is shut off, but the check valve 81 prevents discharge of fluid from the lower chamber to hold the ram in a raised condition.

As previously described, a tool change switch TC is provided and is operable to a tool change position in which it energizes the valve actuator 96*a* to supply fluid pressure to the lower chamber 35*b* of the ram actuator and also operates bypass valve actuator 91 to bypass a supply of fluid pressure to the stripper sleeve clamp to allow the ram to move to a raised tool change position substantially above the normal raised position and controlled by the upper tool change limit switch 118.

The embodiments of the invention in which an exclusive property or privilege is claimed are defined as follows:

1. A punch press comprising, a press frame having stationary tool means thereon, ram means having movable tool means thereon, hydraulic ram actuator means including a cylinder mounted on said frame and a piston in said cylinder and operatively connected to said ram means for moving the latter along a ram axis, the piston dividing the cylinder into a first fluid pressure chamber at one side of the piston operative when fluid pressure is supplied thereto to move the ram means in a forward direction toward the stationary tool means and a second fluid pressure chamber at the other side of the piston operative when fluid pressure is supplied thereto to move the ram means in a return direction away from the stationary tool means, stripper sleeve means coaxial with the ram means and guidably engaging the latter for relative axial movement therebetween and having a work engaging end, stripper clamp means including (a) a clamp housing fixed on the press frame and encircling the stripper sleeve means and (b) hydraulically operated clamp means having an outer portion engaging the clamp housing and an annular inner portion encircling the stripper sleeve means, said hydraulically operated clamp means being normally in a release condition in which the annular inner portion guidably engages said stripper sleeve means and being operable in response to supply of fluid pressure thereto to a clamp condition in which the annular inner portion is expanded radially inwardly into clamping engagement with the stripper sleeve means, hydraulic fluid pressure supply means including control valve means for operating the control valve means to a first condition supplying fluid pressure to said first chamber of said cylinder to move the ram means in a forward direction, stripper operating spring means operative when the ram means is moved in said forward direction to yieldably bias said stripper sleeve means in a forward direction toward said stationary tool means to press a work piece against the stationary tool means, means operative when the ram means reaches a preselected forward position for operating said control valve means to a second condition, said control valve means being operative in said second condition (a) to supply fluid pressure to said hydraulically operated clamp means to expand the inner portion radially inwardly and clamp the stripper sleeve means against movement relative to the clamp housing, and (b) to supply fluid pressure to said second chamber of said cylinder to move the ram means in said return direction away from the stationary tool means, means operative when the ram means is moved in said return direction to a preselected return position for operating said control valve means to a third condition shutting-off supply of fluid pressure to said hydraulically operated clamp means to allow the clamp means to return to its normal release condition and release the stripper sleeve means, said stripper operating spring means including means operative to yieldably bias the stripper sleeve means in a return direction away from the stationary tool means when the ram means is in said preselected return position and the hydraulically operated clamp means is operated to its release condition.

2. A punch press according to claim 1 wherein said fluid pressure supply means includes sequence valve means operative when the flow control valve means is in said second condition to delay supply of fluid pressure to the second chamber until the fluid pressure supplied to the hydraulically operated clamp means exceeds a preselected pressure sufficient to operate the hydraulically operated clamp means to its clamp condition.

3. A punch press according to claim 2 wherein said fluid pressure supply means includes valve means operative when the control valve means is in said third condition to block flow of fluid from the second chamber and hold the ram means in said return position and operative when the flow control means is in said first condition to allow discharge of fluid from the second chamber.

4. A punch press according to claim 1 wherein said stripper operating spring means includes clamp spring means operatively engaging the ram means and the stripper sleeve means for yieldably urging the stripper sleeve means in a forward direction relative to the ram means and a return spring means operatively engaging the ram means and the stripper sleeve means for yieldably urging the stripper sleeve means in a return direction relative to the ram means, said stripper operating spring means being constructed and arranged such that the work engaging end of the stripper sleeve means is forward of the end of the movable tool means when the ram means is moved in said forward direction from said return position so that the work engaging end of the stripper sleeve means engages the workpiece to press the workpiece against the stationary tool means before the movable tool means engages the workpiece.

5. A punch press according to claim 4 wherein said fluid pressure supply means includes sequence valve means operative when the flow control valve means is in said second condition to delay supply of fluid pressure second chamber until the fluid pressure supplied to the hydraulically operated clamp means exceeds a preselected pressure sufficient to operate the hydraulically operated clamp means to its clamp condition.

6. A punch press according to claim 1 wherein said hydraulically operated clamp means includes annular bushing means operative to radially expand when axially compressed, and hydraulically operated annular piston means for axially compressing the annular bushing means.

7. A punch press according to claim 1 wherein the hydraulic fluid pressure supply means includes bypass valve means operable to a bypass condition to bypass supply of fluid pressure to said hydraulically operated clamp means, and selectivly operable means for operating control valve means to said second condition and for operating said bypass valve means to said bypass condition to enable moving said ram means in said return direction to a tool change position.

8. A punch press according to claim 7 including means operative when said ram means reaches said tool change position for operating said control valve means to said third condition.

9. A punch press comprising, a press frame having stationary tool means thereon, ram means having movable tool means on the lower end thereof, hydraulic ram actuator means including a cylinder mounted on said frame and a piston in said cylinder and operatively connected to said ram means for moving the latter up and down along a ram axis, the piston dividing the cylinder into a first fluid pressure chamber at one side of the piston operative when fluid pressure is supplied thereto to move the ram means downwardly toward the stationary tool means and a second fluid pressure chamber at the other side of the piston operative when fluid pressure is supplied thereto to move the ram means upwardly away from the stationary tool means, stripper sleeve means coaxial with the ram means and guidably engaging the latter for relative axial movement therebetween and having a lower work engaging end, stripper clamp means including (a) a clamp housing fixed on the press frame and encircling the stripper sleeve means and (b) hydraulically operated clamp means having an outer portion engaging the clamp housing and an annular inner portion engaging the stripper sleeve means, said hydraulically operated clamp means being operable between a release condition in which the annular inner portion guidably engages said stripper sleeve means when fluid pressure is exhausted therefrom to a clamp condition in which the annular inner portion is expanded radially inwardly into clamping engagement with the stripper sleeve means when fluid pressure is supplied thereto, hydraulic fluid pressure supply means including four-way control valve means operable to a first condition supplying fluid pressure to said first chamber of said cylinder while exhausting fluid pressure from said second chamber to move the ram means downwardly, said stripper operating spring means including clamp spring means operatively engaging the ram means and the stripper sleeve means for yieldably urging the stripper sleeve means downwardly relative to the ram means and a return spring means operatively engaging the ram means and the stripper sleeve means for yieldably urging the stripper sleeve upwardly relative to the ram means, said stripper operating spring means being constructed and arranged such that the work engaging end of the stripper sleeve means is disposed below the lower end of the movable tool means when the ram means is moved downwardly so that the work engaging end of the stripper sleeve means engages the workpiece before the movable tool means engages the workpiece to press the workpiece against the die means, means operative when the ram means reaches a preselected lower punch position for operating said control valve means to a second condition, said control valve means being operative in said second condition (a) to supply fluid pressure to said hydraulically operated clamp means to expand the inner portion radially inwardly and clamp the stripper sleeve means against movement relative to the clamp housing and (b) to supply fluid pressure to said second chamber of said cylinder while exhausting fluid pressure from the first chamber to move the ram means upwardly away from the die means, means operative when the ram means is raised to a preselected return position for operating said control valve means to a third condition, said control valve means being operative in said third condition to exhaust fluid pressure from said hydraulically operated clamp means to release the clamp means and allow the stripper sleeve means to move upwardly under the bias of said return spring means.

10. A punch press according to claim 9 wherein said fluid pressure supply means includes sequence valve means operative when the control valve means is in said second condition to delay supply of fluid pressure to the second chamber until the fluid pressure supplied to the hydraulically operated clamp means exceeds a preselected pressure sufficient to operate the hydraulically operated clamp means to its clamp condition.

11. A punch press according to claim 10 wherein said fluid pressure supply means includes means operative when the control valve means is in said third condition for blocking flow of fluid from the second chamber to hold the ram means in said return position.

12. A punch press according to claim 9 wherein said hydraulically operated clamp means includes annular bushing means operative to radially expand when axially compressed, and a hydraulically operated annular piston means for axially compressing the annular bushing means.

13. A punch press according to claim 9 wherein the hydraulically fluid pressure supply means includes bypass valve means operable to a bypass condition to bypass supply of fluid pressure to said hydraulically operated clamp means, and selectively operable means for operating the control valve means to said second condition and for operating said bypass valve means to said bypass condition to enable moving said ram means in said return direction to a tool change position above said return position.

14. A punch press according to claim 13 including means operative when said ram means reaches said tool change position for operating said control valve means to said third condition.

15. A punch press according to claim 9 wherein said stripper operating spring means includes an annular abutment member encircling said ram means and movable axially relative to the ram means and stripper sleeve means, said stripper sleeve means having an upwardly facing stop shoulder engageable with said abutment member, said ram means having an upwardly facing stop shoulder engageable with said abutment member, said return spring comprising a coil spring encircling said ram member at a location below the abutment member and having its lower end engaging an upwardly facing shoulder on the ram means and its upper end engaging a downwardly facing shoulder on the stripper sleeve means to yieldably bias the stripper sleeve means upwardly relative to the ram means, the clamp spring means comprising a coil type spring encircling the ram means at a location above the abutment member and having its upper end engaging a downwardly facing shoulder on the ram means and its lower end engaging the abutment member, the clamp spring means being arranged to yieldably press the abutment member downwardly against the upwardly facing stop shoulder on the stripper sleeve means and to press the stripper sleeve means downwardly in opposition to the return spring until the abutment member engages the upwardly stop shoulder on the ram means.

* * * * *